US011111061B2

(12) United States Patent
Nagai et al.

(10) Patent No.: US 11,111,061 B2
(45) Date of Patent: Sep. 7, 2021

(54) LIQUID STORAGE BOTTLE

(71) Applicant: CANON KABUSHIKI KAISHA, Tokyo (JP)

(72) Inventors: Noriyasu Nagai, Tokyo (JP); Kenta Udagawa, Tokyo (JP); Hiroshi Koshikawa, Yokohama (JP); Hiroki Hayashi, Kawasaki (JP); Manabu Ohara, Kawasaki (JP); Shoki Takiguchi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/827,463

(22) Filed: Mar. 23, 2020

(65) Prior Publication Data

US 2020/0307872 A1 Oct. 1, 2020

(30) Foreign Application Priority Data

Mar. 29, 2019 (JP) ..... JP2019-069101

(51) Int. Cl.
*B65D 47/20* (2006.01)
*B41J 2/175* (2006.01)

(52) U.S. Cl.
CPC ..... *B65D 47/2031* (2013.01); *B41J 2/1754* (2013.01); *B41J 2/17506* (2013.01)

(58) Field of Classification Search
CPC ..... B41J 2/17566; B41J 2/17506; B41J 2002/17573; B41J 2/1754; B65D 47/2031
See application file for complete search history.

(56) References Cited

U.S. PATENT DOCUMENTS

2020/0238722 A1* 7/2020 Ishizawa ..... B41J 29/13

FOREIGN PATENT DOCUMENTS

JP 2018-95277 A 6/2018

* cited by examiner

*Primary Examiner* — Thinh H Nguyen
(74) *Attorney, Agent, or Firm* — Canon U.S.A., Inc. IP Division

(57) ABSTRACT

A liquid storage bottle includes a nozzle which has an inlet through which a liquid is injected, a cylindrical cap which is mountable on the nozzle to open or close the inlet, a slit valve which is provided in the inlet and includes a plurality of slits intersecting each other, and a sealing unit which seals the inlet when the cap is mounted on the nozzle. The cap includes a protrusion which protrudes from a surface facing the inlet toward the slit valve when the cap is mounted on the nozzle, and a tip portion of the protrusion faces the slit valve at a position separated in a radial direction of the nozzle from an intersection of the plurality of slits in a state where the inlet is sealed by the sealing unit.

17 Claims, 15 Drawing Sheets

LIQUID STORAGE BOTTLE

BACKGROUND OF THE DISCLOSURE

Field of the Disclosure

The present disclosure relates to a liquid storage bottle which stores a liquid therein.

Description of the Related Art

In a liquid tank used in a liquid ejection apparatus such as an ink jet recording apparatus, a liquid can be replenished from a separately prepared liquid storage bottle through an inlet for injecting the liquid. In the liquid storage bottle for replenishing the liquid, in order to prevent hands or surroundings of a user from becoming dirty, in most cases, a slit valve which is opened and closed depending on an internal pressure of the bottle is provided in the inlet for injecting the liquid separately from a sealable cap. Moreover, Japanese Patent Application Laid-Open No. 2018-95277 discloses a method of maintaining a state where a slit valve is opened even when an inlet is sealed by a cap, in order to prevent the slit valve from not being opened due to solidification of a liquid when not used, such as during long-term storage. In this method, when the cap is mounted on a nozzle, a protrusion provided on a bottom surface of the cap is inserted into a slit of the slit valve, and thus, it is possible to maintain the state where the slit valve is open.

However, in the method disclosed in Japanese Patent Application Laid-Open No. 2018-95277, at a time when sealing of the inlet is released by the cap when the cap is opened, the protrusion is not inserted into the slit and the slit valve is closed. Accordingly, an inside of the bottle is sealed. Therefore, if an internal pressure of the liquid storage bottle is higher than an outside air pressure, even when a bottle main body is simply tilted to inject the liquid, a head pressure of the liquid inside the bottle acts on the slit valve and exceeds a pressure required to open the slit, and thus, the liquid may leak out.

SUMMARY OF THE DISCLOSURE

According to the present disclosure, there is provided a liquid storage bottle including: a bottle main body; a nozzle which has an inlet through which a liquid stored in the bottle main body is injected; a cylindrical cap which is mountable on the nozzle to open or close the inlet; a slit valve which is provided in the inlet and includes a plurality of slits intersecting each other; and a sealing unit which seals the inlet when the cap is mounted on the nozzle, in which the cap includes a protrusion which protrudes from a surface facing the inlet toward the slit valve when the cap is mounted on the nozzle. According to an aspect, a tip portion of the protrusion faces the slit valve at a position separated in a radial direction of the nozzle from an intersection of the plurality of slits in a state where the inlet is sealed by the sealing unit, and according to another aspect, the protrusion is inserted into the slit to open the slit during a period from a state where the inlet is sealed by the sealing unit to a state where sealing of the inlet is released by the sealing unit.

Further features and aspects of the present disclosure will become apparent from the following description of example embodiments with reference to the attached drawings.

DESCRIPTION OF THE EMBODIMENTS

Figure 1:
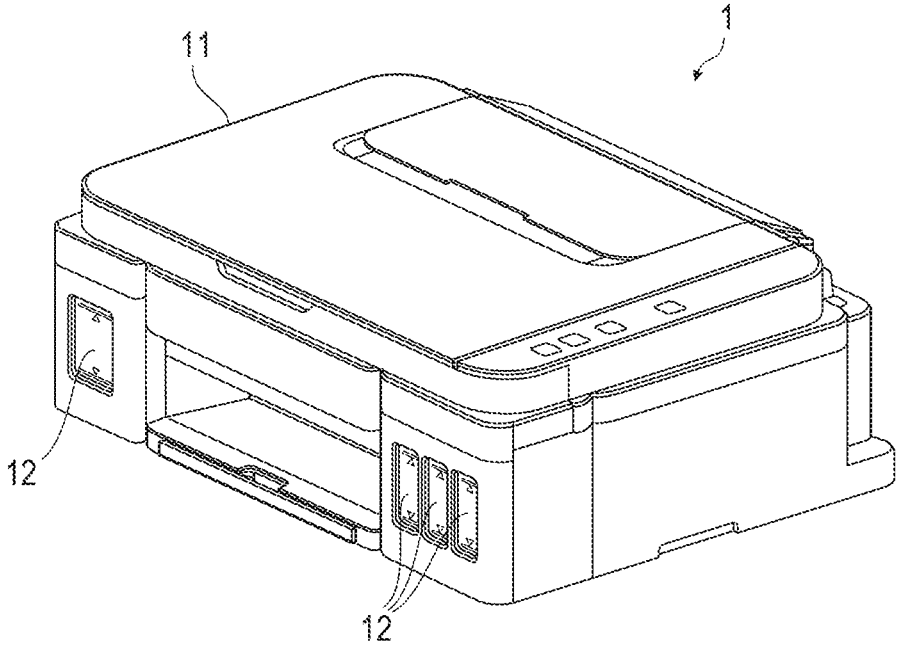
FIG. 1 is a perspective view of an example liquid ejection apparatus for which a liquid storage bottle of the present disclosure is used.

The present disclosure is directed to providing a liquid storage bottle capable of suppressing liquid leakage even when a bottle main body is tilted in order to inject a liquid.

Hereinafter, embodiments of the present disclosure will be described with reference to the drawings. In the present specification, a case where a liquid ejection apparatus (ink jet recording apparatus) is replenished with a liquid (ink) will be described as an example of use of a liquid storage bottle of the present disclosure. However, the use of the liquid storage bottle is not limited to this. Moreover, in the following descriptions, configurations having the same functions are denoted by the same reference numerals in the drawings, and descriptions thereof may be omitted.

FIG. 1 is a perspective view of a liquid ejection apparatus using a liquid storage bottle of the present disclosure.

A liquid ejection apparatus 1 is a serial type ink jet recording apparatus, and has a housing 11 and large-capacity liquid tanks 12 which are disposed inside the housing 11. The liquid tank 12 stores ink which is a liquid ejected to a recording medium (not illustrated).

Figure 2:
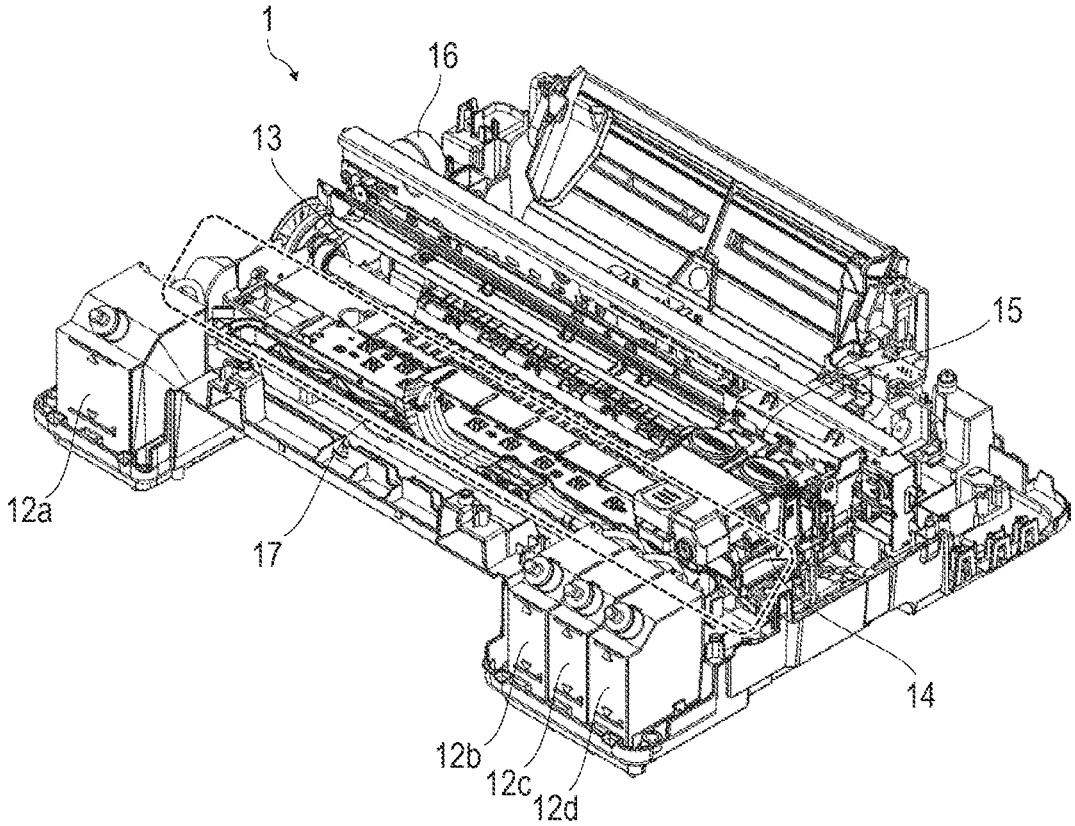
FIG. 2 is a perspective view illustrating an example internal configuration of a main part of the liquid ejection apparatus illustrated in FIG. 1.

FIG. 2 is a perspective view illustrating an internal configuration of a main part of the liquid ejection apparatus illustrated in FIG. 1.

The liquid ejection apparatus 1 includes a conveying roller 13 which conveys the recording medium (not illustrated), a carriage 15 in which a recording head 14 for ejecting a liquid is provided, and a carriage motor 16 which drives the carriage 15. For example, the recording medium is paper. However, the recording medium is not particularly limited as long as an image is formed by the liquid ejected from the recording head 14. The conveying roller 13 is intermittently driven rotationally, and thus, the recording medium is intermittently conveyed. As the carriage motor 16 is rotationally driven, the carriage 15 reciprocates in a direction intersecting a conveying direction of the recording medium, and the liquid is ejected to the recording medium from an ejection orifice provided in the recording head 14 during reciprocating scanning of the carriage 15. Accordingly, the image is recorded on the recording medium.

The liquid is stored in the liquid tank 12 and is supplied to the recording head 14 through a liquid flow path 17. As the liquid, ink of four colors (for example, cyan, magenta, yellow and black) is used, and as the liquid tank 12, four liquid tanks 12*a* to 12*d* each storing the ink of each color are provided. Each of the four liquid tanks 12*a* to 12*d* is disposed in a front surface portion of the liquid ejection apparatus 1 inside the housing 11.

Figure 3:
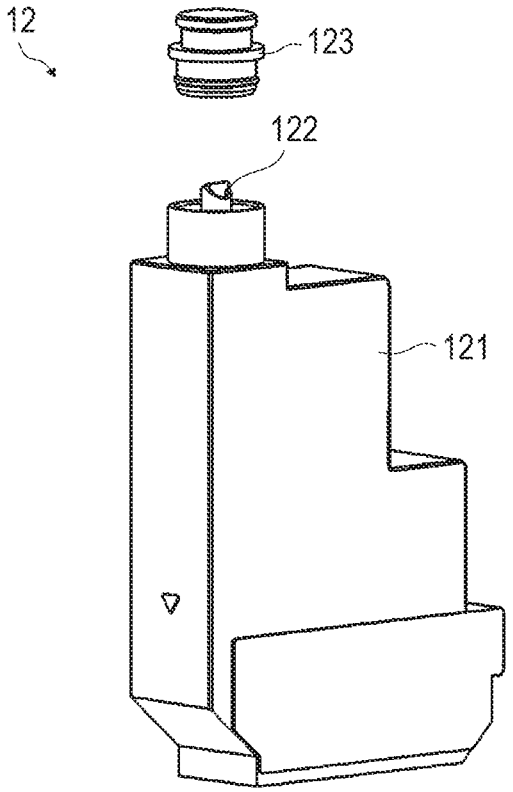
FIG. 3 is a perspective view of an example liquid tank of the liquid ejection apparatus illustrated in FIG. 1.

FIG. 3 is a perspective view of the liquid tank of the liquid ejection apparatus illustrated in FIG. 1.

The liquid tank 12 includes a tank main body 121 which stores the liquid, an inlet 122 which communicates with a liquid storage chamber in the tank main body 121, and a tank cover 123 which is mountable on the tank main body 121 so as to cover the inlet 122. The tank cover 123 is removed from the tank main body 121, and thus, the liquid tank 12 is replenished with the liquid through the exposed inlet 122. After the liquid is replenished, the tank cover 123 is mounted on the tank main body 121 in order to suppress evaporation of the ink from the liquid storage chamber in the tank main body 121, and thus, the liquid storage chamber in the tank main body 121 is sealed.

First Example Embodiment

Figure 4:
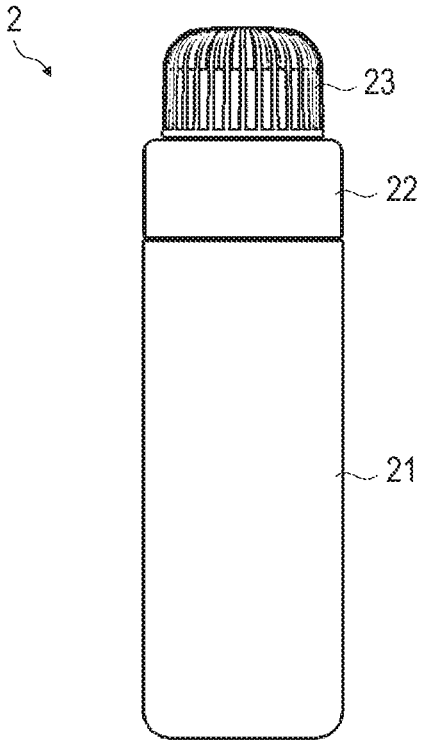
FIG. 4 is a side view of a liquid storage bottle according to a first example embodiment.
Figure 5:
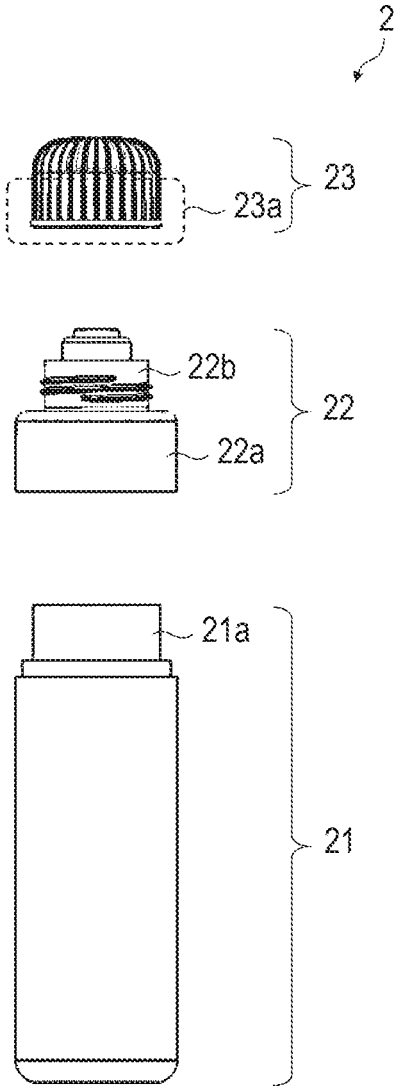
FIG. 5 is an exploded side view of the liquid storage bottle illustrated in FIG. 4.

FIG. 4 is a side view of a liquid storage bottle according to a first embodiment of the present disclosure. FIG. 5 is an exploded side view of the liquid storage bottle illustrated in FIG. 4.

The liquid storage bottle 2 is a cylindrical container for replenishing the liquid tank 12 with the liquid, and includes a bottle main body 21 which stores the liquid, a nozzle 22 and a cap 23. The nozzle 22 is fixed to the bottle main body 21 and has a function of injecting the liquid stored in the bottle main body 21. The cap 23 can be mounted on the nozzle 22 so as to open and close an inlet 22*c* described later of the nozzle 22, and has a function of shielding an inside of the bottle main body 21 from an outside air and sealing the liquid storage bottle 2. In the present embodiment, both the bottle main body 21 and the nozzle 22 are resin parts and are fixed to each other by welding as described later. However, the bottle main body 21 and the nozzle 22 may be sealed with a flexible part therebetween so as to be fixed to each other.

A bottle welding portion 21*a* is formed in an upper portion of the bottle main body 21, and a nozzle welding portion 22*a* is formed in a lower portion of the nozzle 22. One of an inner peripheral surface and a bottom surface of the nozzle welding portion 22*a* is welded to the bottle welding portion 21*a*, and thus, the nozzle 22 is fixed to the bottle main body 21. A nozzle screw portion 22*b* having a male screw formed on an outer peripheral surface is formed at a center portion of the nozzle 22, and a cap screw portion 23*a* having a female screw formed on an inner peripheral surface is formed in a lower portion of the cap 23. The male screw of the nozzle screw portion 22*b* is screwed to the female screw of the cap screw portion 23*a*, and thus, the cap 23 is mounted on the nozzle 22.

Figure 6A:
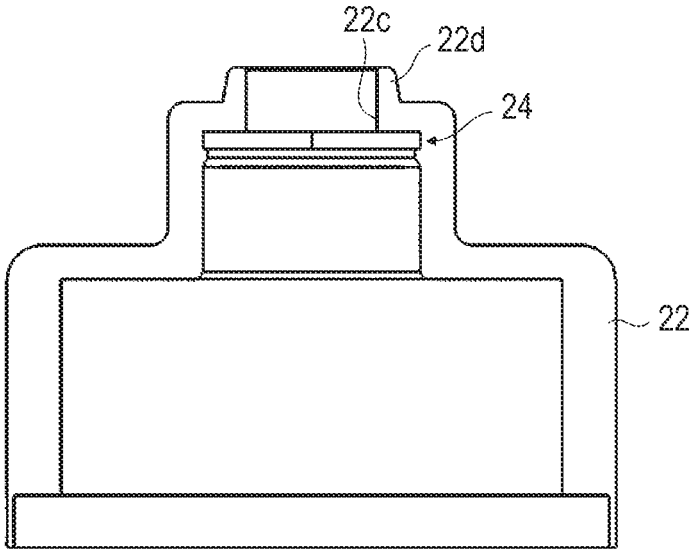
FIGS. 6A and 6B are a cross-sectional view and a plan view of a nozzle of the first example embodiment, respectively.
Figure 6B:
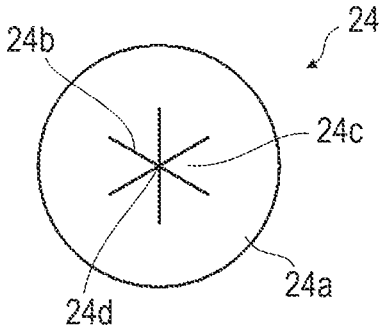
Figure 7:
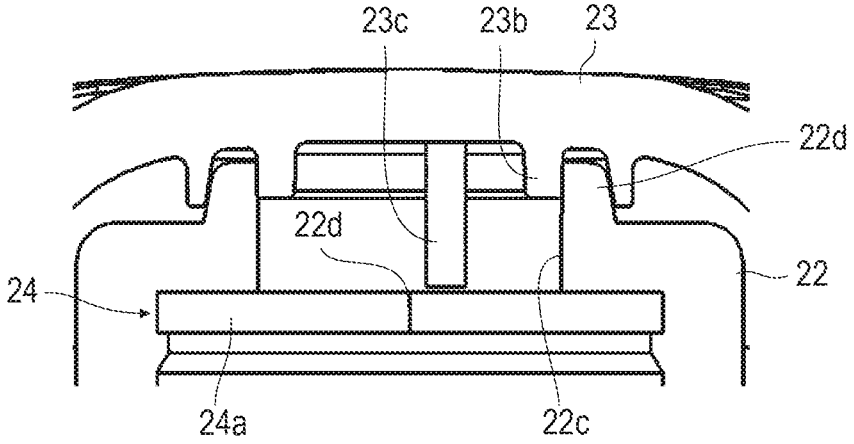
FIG. 7 is a cross-sectional view of the nozzle and a cap according to the first example embodiment.

FIG. 6A is a cross-sectional view of a nozzle of the present embodiment, and FIG. 6B is a plan view of a slit valve provided in the nozzle of the present embodiment. FIG. 7 is an enlarged cross-sectional view of the nozzle and the cap of the present embodiment.

The nozzle 22 has an inlet 22*c* which injects the liquid, and a nozzle seal portion 22*d* formed of an annular rib provided along a peripheral edge portion of the inlet 22*c*. A slit valve 24 which is opened or closed depending on an internal pressure of the liquid storage bottle 2 is provided in the inlet 22*c*. The slit valve 24 has a valve body 24*a* which is made of a material having flexibility and three slits 24*b* which are formed in the valve body 24*a* and intersect each other, and in a closed state, the slit valve 24 can seal the inlet 22*c*. Six split pieces 24*c* are formed in the valve body 24*a* by the three slits 24*b*. Moreover, the number of slits 24*b* is not limited to this, and may be two or four or more. In this case, a plurality of slits 24*b* can be formed so as to be 2n times symmetrical with respect to a center of the circular valve body 24*a* as illustrated in the figures, where n is the number. Accordingly, the split pieces 24*c* can be evenly opened, and the liquid in the liquid storage bottle 2 can be smoothly injected.

A cap seal portion 23*b* which is formed of an annular rib and a protrusion 23*c* which protrudes toward the slit valve 24 are provided on a bottom surface (a surface opposite to the inlet 22*c*) of the cap 23. The cap seal portion 23*b* is fitted to the nozzle seal portion 22*d* when the cap 23 is mounted on the nozzle 22, and thus, functions as a sealing unit which seals the inlet 22*c* together with the nozzle seal portion 22*d*. In a state where the inlet 22*c* is sealed by the cap seal portion 23*b* and the nozzle seal portion 22*d*, and a tip portion of the protrusion 23*c* faces the valve body 24*a* of the slit valve 24 at a position separated from an intersection 24*d* of the plurality of slits 24*b* in a lateral direction (a radial direction of the nozzle 22). According to this configuration of the protrusion 23*c*, as described later, in a case where the internal pressure of the liquid storage bottle 2 is higher than an outside air pressure when the cap 23 is opened, it is possible to release the internal pressure. In the present embodiment, the protrusion 23*c* is provided integrally with the cap 23. However, the protrusion 23*c* may be provided separately from the cap 23.

Figure 8A:
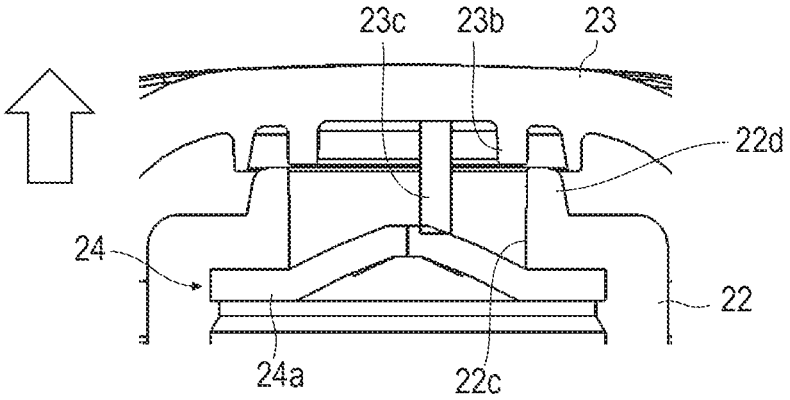
FIGS. 8A, 8B, 8C, and 8D are cross-sectional views illustrating a relationship between a slit valve and a protrusion when the cap is opened or closed.
Figure 8B:
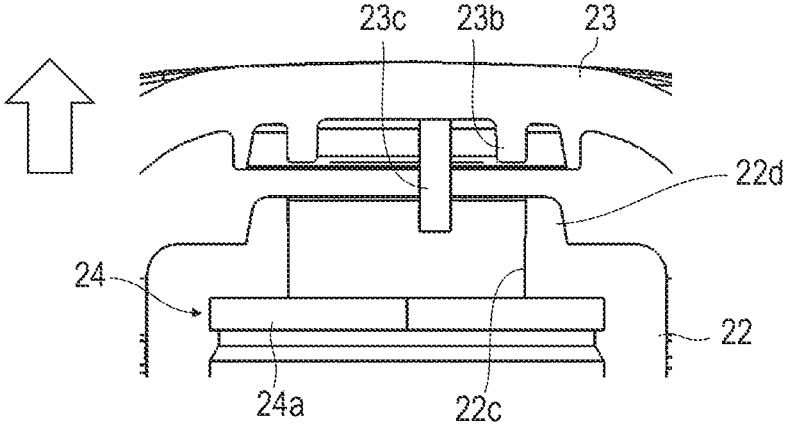

FIGS. 8A and 8B are cross-sectional views illustrating a relationship between the slit valve and the protrusion when the cap is opened.

In a state where the cap 23 is mounted on the nozzle 22 and the inlet 22*c* is sealed, as described above, the protrusion 23*c* faces the valve body 24*a* at the position separated from the intersection 24*d* of the slit 24*b* in the lateral direction and is not in contact with the valve body 24*a*. Here, if the cap 23 starts to be opened, the fitting between the cap seal portion 23*b* and the nozzle seal portion 22*d* is released, and the sealing of the inlet 22*c* is released. In this case, when the internal pressure of the liquid storage bottle 2 is higher than the outside air pressure, as illustrated in FIG. 8A, the valve body 24*a* of the slit valve 24 is deformed to expand outward due to the internal pressure of the liquid storage bottle 2. Then, if the expanded valve body 24*a* comes into contact with the protrusion 23*c*, the slit 24*b* is opened to release the pressure in the liquid storage bottle 2, and the expansion of the valve body 24*a* is eliminated. Thereafter, if the cap 23 is removed, as illustrated in FIG. 8B the slit 24*b* is closed and the inlet 22*c* is sealed again. When the liquid is injected from the liquid storage bottle 2 to the liquid tank 12, a pressure difference between the inside and the outside of the liquid storage bottle 2 is eliminated, and the inlet 22*c* is sealed. Accordingly, it is not possible to apply a pressure required to open the slit 24*b* to the slit valve 24 by merely tilting the bottle main body 21, and thus, it is possible to prevent the liquid from leaking out from the inlet 22*c*.

Figure 8C:
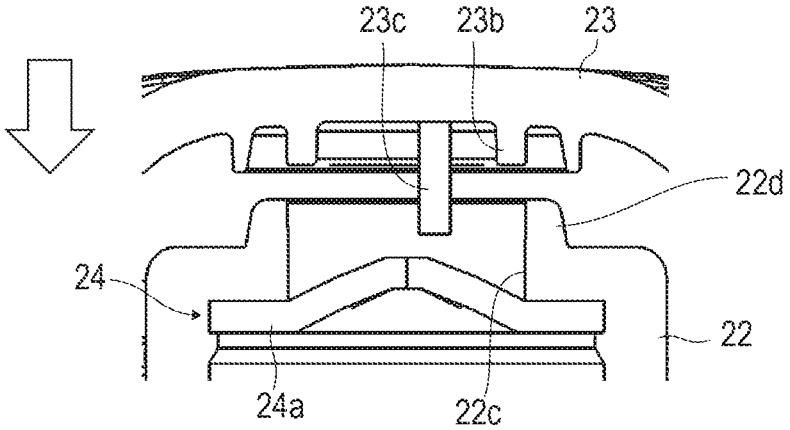
Figure 8D:
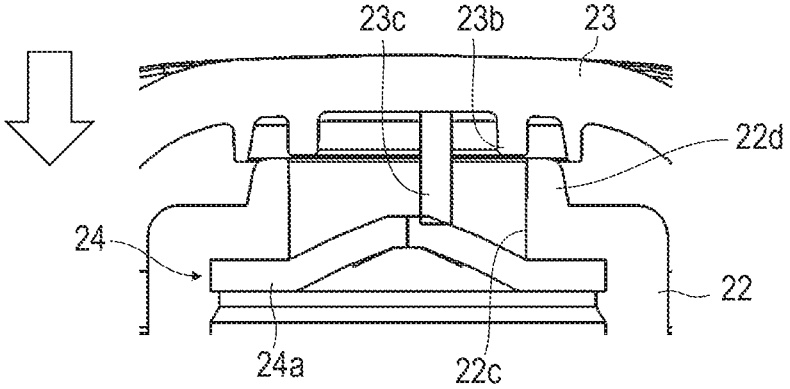

Meanwhile, FIGS. 8C and 8D are cross-sectional views illustrating a relationship between the slit valve and the protrusion when the cap is closed.

If the internal pressure of the liquid storage bottle 2 increases in a state where the cap 23 is not mounted on the nozzle 22, as illustrated in FIG. 8C, the valve body 24*a* of the slit valve 24 is expanded outward and deformed. Here, if the cap 23 starts to be closed, as illustrated in FIG. 8D, the protrusion 23*c* comes into contact with the expanded valve body 24*a* before the cap seal portion 23*b* and the nozzle seal portion 22*d* are fitted to each other. Accordingly, after the slit 24*b* is opened to release the pressure in the liquid storage bottle 2 and the expansion of the valve body 24*a* is eliminated, the slit 24*b* is closed and the inlet 22*c* is sealed. In addition, if the cap 23 is further closed, the cap seal portion 23*b* and the nozzle seal portion 22*d* are fitted to each other and the inlet 22*c* is sealed. In this case, since the expansion of the valve body 24*a* is eliminated, the protrusion 23*c* faces the valve body 24*a* at the position separated from the intersection 24*d* of the slit 24*b* in the lateral direction and is not in contact with the valve body 24*a*.

According to this configuration, even in a case where the internal pressure of the liquid storage bottle 2 increases, the protrusion 23*c* comes into contact with the slit valve 24 when the cap 23 is opened or closed. Therefore, the internal pressure can be released to the outside. Moreover, a length of the protrusion 23*c* is not particularly limited and can be set to an optimal length according to an amount of deformation of the valve body 24*a* which is actually deformed by an increase in the internal pressure of the liquid storage bottle 2. Therefore, for example, in a case where the amount of deformation of the valve body 24*a* is relatively small, in a state where the inlet 22*c* is sealed by the cap seal portion 23*b* and the nozzle seal portion 22*d*, the tip portion of the protrusion 23*c* may be in contact with the valve body 24*a* to such an extent that the valve body 24*a* is not deformed.

Moreover, if the protrusion 23*c* is only to be brought into contact with the expanded valve body 24*a*, it is also considered that the tip portion of the protrusion 23*c* faces the intersection 24*d* of the slit 24*b* in a state where the cap 23 is mounted on the nozzle 22 (a state where the inlet 22*c* is sealed) as illustrated in FIG. 7. However, in this case, depending on a thinness of the protrusion 23*c*, when the valve body 24*a* expands, the protrusion 23*c* is inserted into the slit 24*b* near the intersection 24*d*. Accordingly, even when the protrusion 23*c* is inserted as described above, the state where the slit 24*b* is closed is maintained. As a result, even if the protrusion 23*c* comes into contact with the expanded valve body 24*a*, the pressure in the liquid storage bottle 2 may not be released. From this viewpoint, the tip portion of the protrusion 23*c* can face the valve body 24*a* of the slit valve 24 at a position laterally separated from the intersection 24*d* of the plurality of slits 24*b* in the state where the inlet 22*c* is sealed.

Each of left sides of FIGS. 9A to 10C is a perspective view illustrating a modification example of the protrusion of the present embodiment, and each of right sides of FIGS. 9A to 10C is a plan view illustrating a relationship between the protrusion according to the modification example and the slit valve. FIGS. 11A to 12B illustrate perspective views illustrating modification examples of the protrusion of the present embodiment, respectively.

Figure 9A:
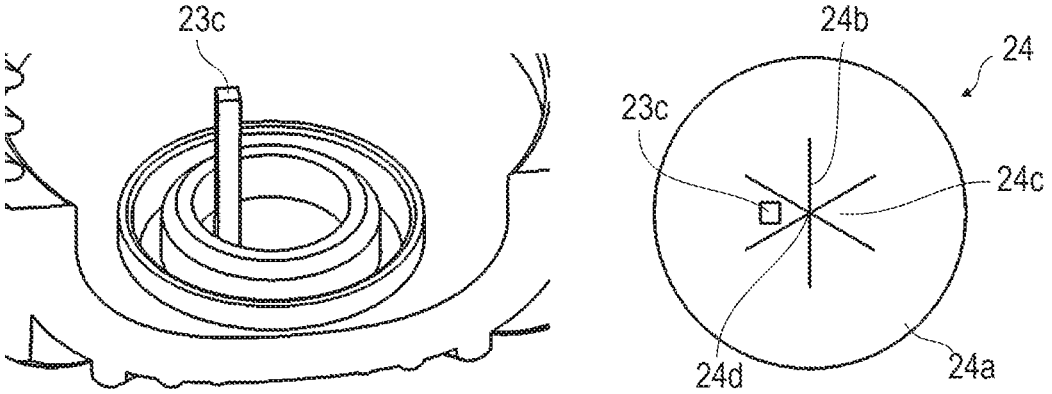
FIGS. 9A, 9B, and 9C are perspective views and plan views illustrating a modification example of the protrusion according to the first example embodiment.
Figure 9B:
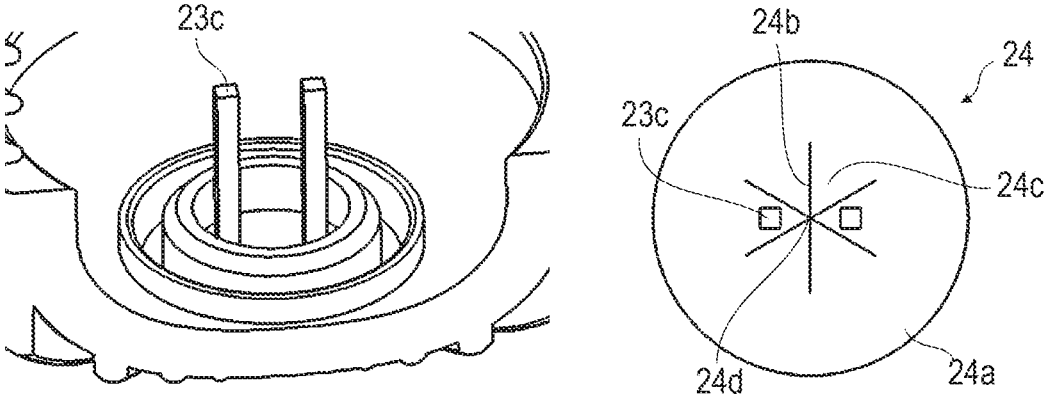
Figure 9C:
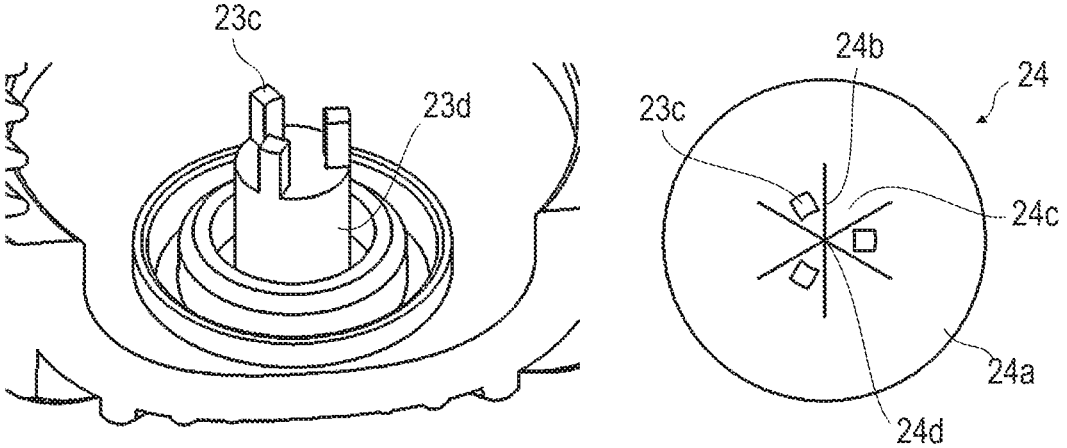

In order for the protrusion 23*c* to come into contact with the expanded valve body 24*a* and open the slit 24*b*, the protrusion 23*c* cannot come into contact with at least one of the plurality of split pieces 24*c* formed by the slit 24*b*. That is, the number of protrusions 23*c* is not limited to one, but a plurality of the protrusions 23*c* may be provided. However, as illustrated in FIGS. 9A to 9C, the number of protrusions 23*c* can be smaller than the number of split pieces 24*c* formed by the slit 24*b*. Further, the protrusion 23*c* may directly protrude from the bottom surface of the cap 23 as illustrated in FIGS. 9A and 9B, or may protrude from an end surface of a columnar base portion 23*d* provided on the bottom surface of the cap 23 as illustrated in FIG. 9C.

Figure 10A:
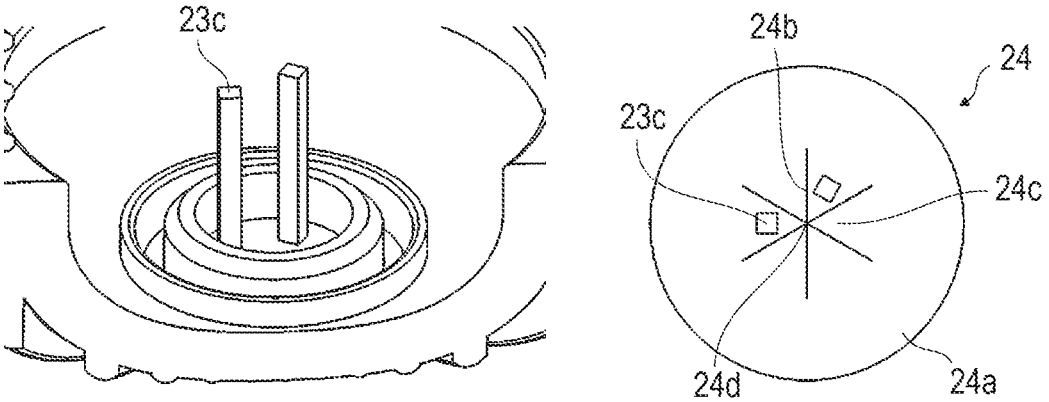
FIGS. 10A, 10B, and 10C are perspective views and plan views illustrating a modification example of the protrusion according to the first example embodiment.
Figure 10B:
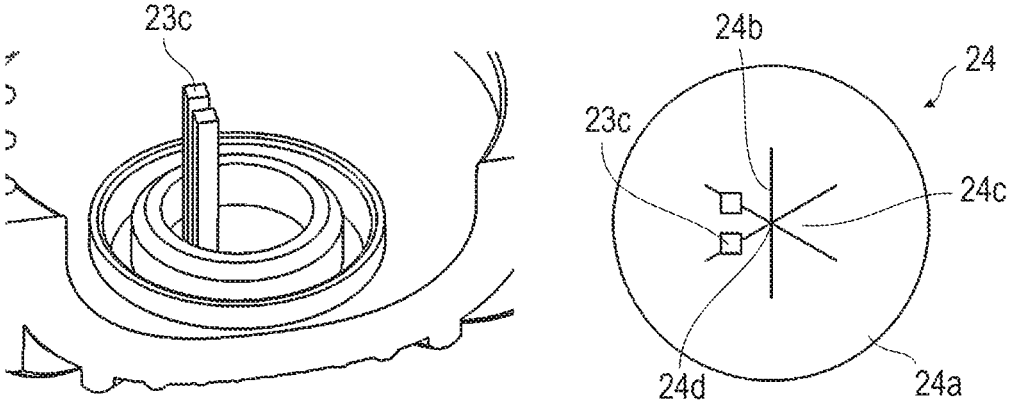
Figure 10C:
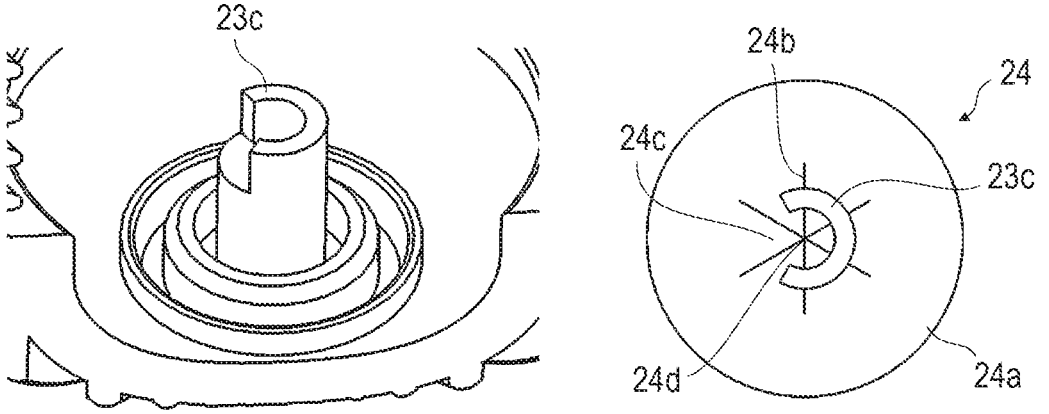

In addition, in a case where a plurality of protrusion 23*c* is provided, as illustrated in FIGS. 10A and 10B, the protrusions 23*c* can face the valve body 24*a* of the slit valve 24 at positions which are rotationally asymmetric with respect to the intersection 24*d* of the slit 24*b*. The protrusion 23*c* may come into surface contact with the valve body 24*a*. In this case, as illustrated in FIG. 10C, the protrusion 23*c* may have a cylindrical shape in which a portion of an end surface cuts away.

Figure 11A:
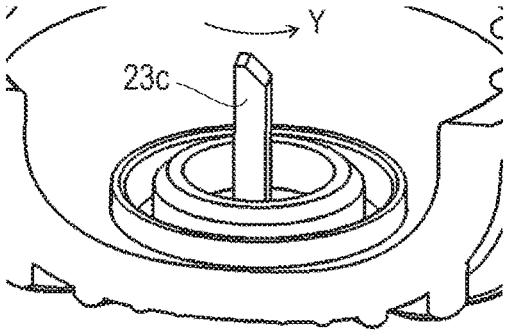
FIGS. 11A, 11B, 11C, 11D, 11E, 11F, and 11G are perspective views illustrating a modification example of the protrusion according to the first example embodiment.
Figure 11B:
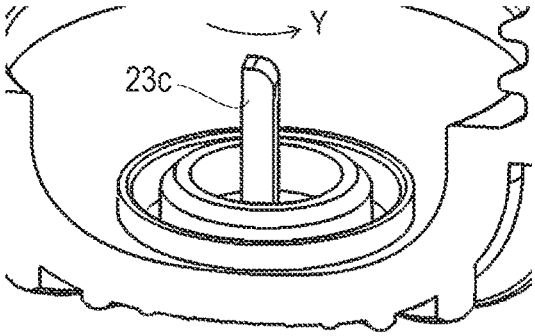
Figure 11C:
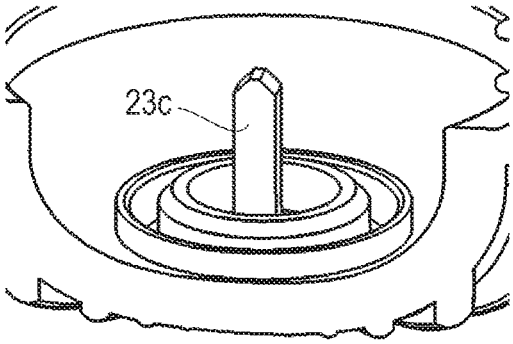
Figure 11D:
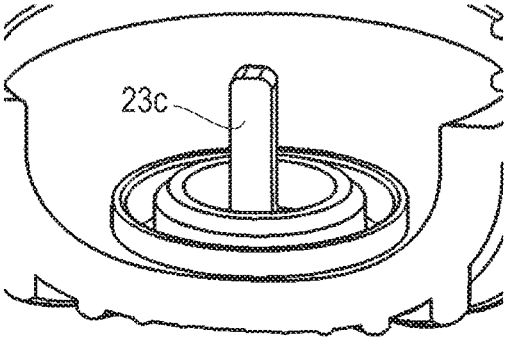
Figure 11E:
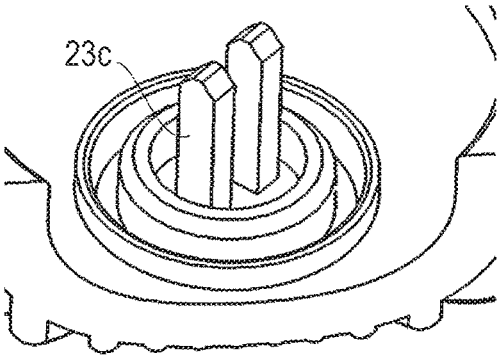
Figure 11F:
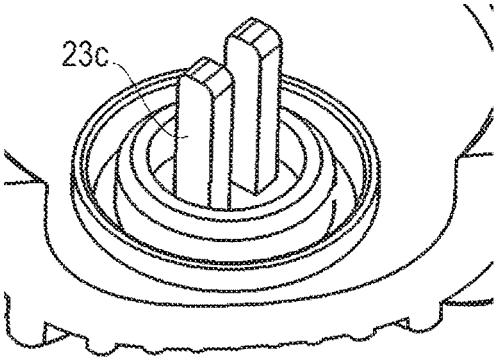
Figure 11G:
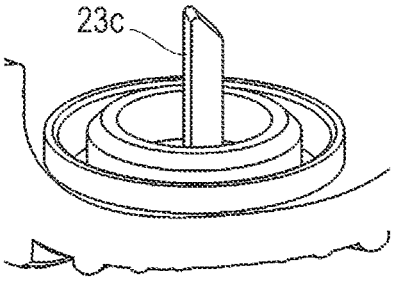

As illustrated in FIGS. 11A and 11B, in the tip portion of the protrusion 23*c*, a corner, which is located on an upstream side in a direction Y in which the protrusion 23*c* moves when the cap 23 is opened, can be chamfered to have a flat surface shape or a curved surface shape. Accordingly, when the contact between the protrusion 23*c* and the valve body 24*a* is released, the protrusion 23*c* is smoothly separated from the valve body 24*a*. Therefore, tips of the split pieces 24*c* are prevented from overlapping each other, and the slit 24*b* can be easily closed. In an example illustrated in FIG. 11B, the tip portion of the protrusion 23*c* is chamfered to be in a curved surface shape. Accordingly, when the protrusion 23*c* comes into contact with the valve body 24*a*, damages which are applied to the valve body 24*a* by the protrusion 23*c* can be reduced. As illustrated in FIGS. 11C and 11D, the chamfer may be provided at the corners located not only on the upstream side but also on a downstream side in the direction Y in which the protrusion 23*c* moves when the cap 23 is opened. That is, the chamfer may be provided at a corner located on the upstream side in the direction in which the protrusion 23*c* moves when the cap 23 is closed. When the plurality of protrusions 23*c* is provided, as illustrated in FIGS. 11E and 11F, the chamfer may be provided at each corner of each protrusion 23*c*. In addition, as illustrated in FIG. 11G, the tip portion of the protrusion 23*c* may be chamfered so as not to have a surface parallel to the valve body 24*a* when the tip portion faces the slit valve 24. Accordingly, when the protrusion 23*c* comes into contact with the valve body 24*a*, damages which are applied to the valve body 24*a* by the protrusion 23*c* can be further reduced.

Figure 12A:
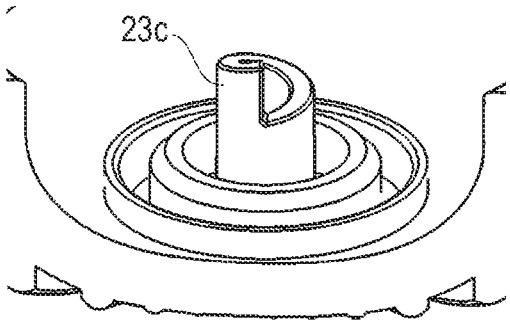
FIGS. 12A and 12B are perspective views illustrating a modification example of the protrusion according to the first example embodiment.
Figure 12B:
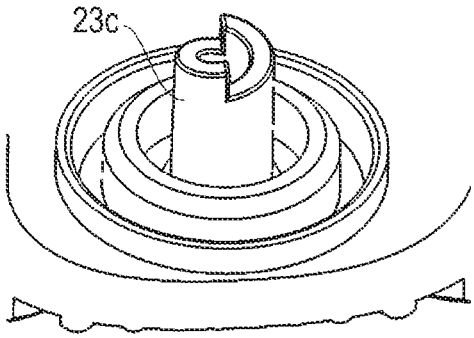

As illustrated in FIG. 12A, the protrusion 23*c* may have a cylindrical shape in which an end surface is formed in a spiral shape, and this spiral end surface can be formed in the same rotation direction and at the same pitch as those of the female screw of the cap screw portion 23*a*. Accordingly, when the cap 23 is opened, the protrusion 23*c* can come into smooth contact with the valve body 24*a*, the damages which are applied to the valve body 24*a* can be reduced, and tips of the split pieces 24*c* are prevented from overlapping each other so that the slit 24*b* is easily closed. Moreover, as illustrated in FIG. 12B, a plurality of spiral end surfaces may be provided at phases different from each other.

Figure 13A:
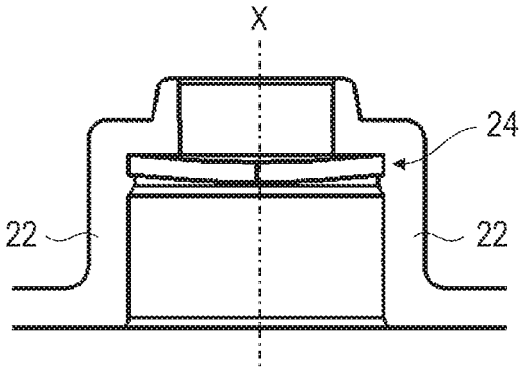
FIGS. 13A, 13B, and 13C are views illustrating a modification example of the slit valve according to the first example embodiment.
Figure 13B:
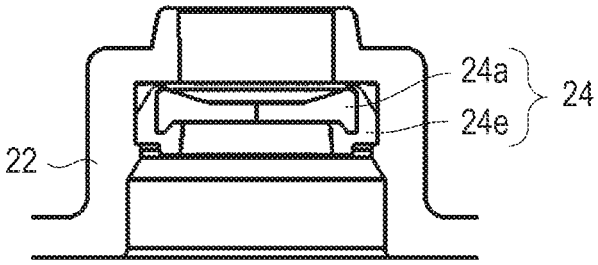
Figure 13C:
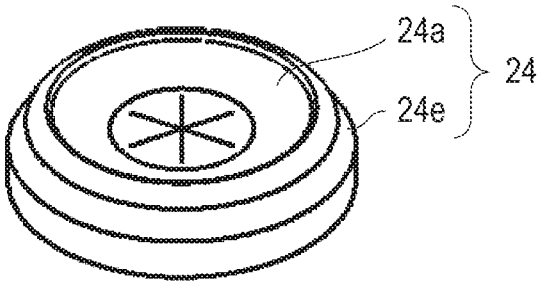

Each of FIGS. 13A and 13B is a cross-sectional view illustrating a modification example of the slit valve of the present embodiment, and FIG. 13C is a perspective view of the slit valve illustrated in FIG. 13B.

As illustrated in FIG. 13A, the slit valve 24 may be recessed inward with respect to a surface perpendicular to an axial direction X of the nozzle 22. In this shape, the valve body 24*a* easily expands outward even with a slight increase in the internal pressure, and thus, the valve body 24*a* can come into ease contact with the protrusion 23*c*. Moreover, as illustrated in FIGS. 13B and 13C, the slit valve 24 may have a rigid frame member 24*e* to which the valve body 24*a* is fitted and held. In this case, the frame member 24*e* is pressed into the nozzle 22 which is also a rigid body, and thus, the slit valve 24 can be prevented from coming off from the nozzle 22.

Second Example Embodiment

Figure 14A:
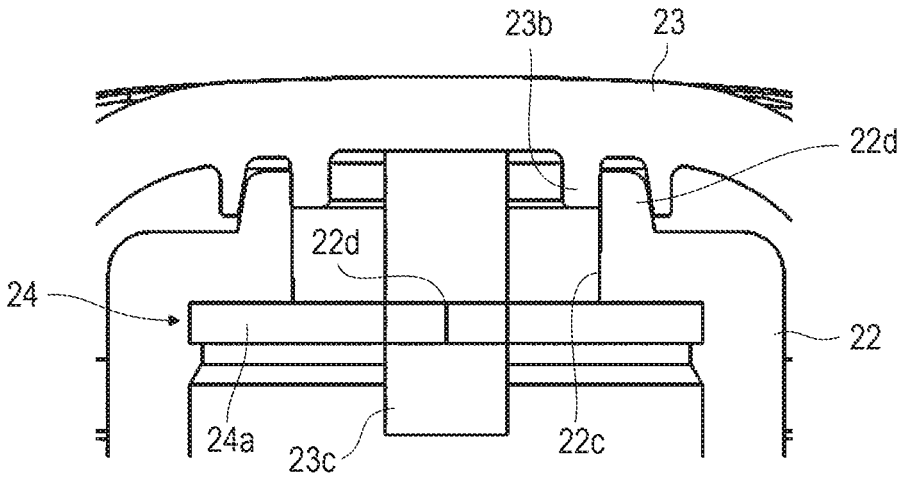
FIGS. 14A and 14B are cross-sectional views of a nozzle and a cap according to a second example embodiment.
Figure 14B:
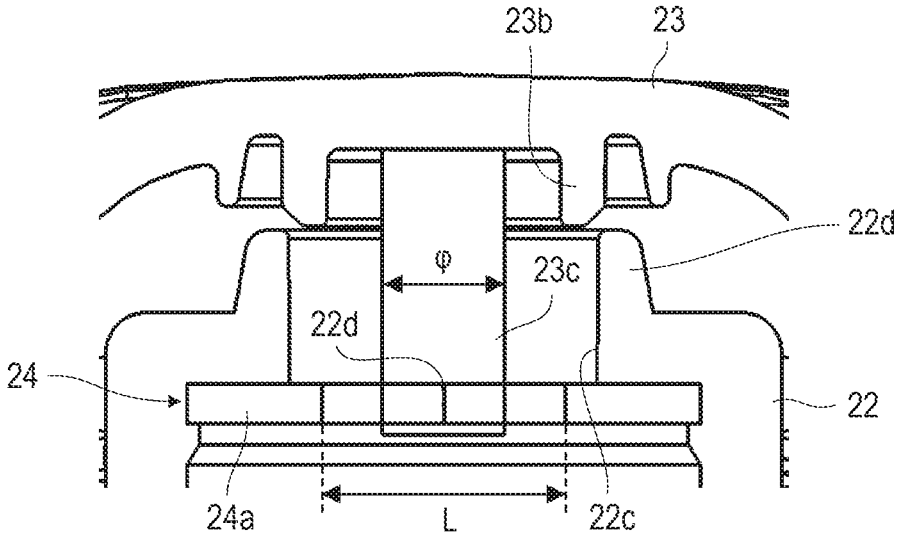
Figure 15A:
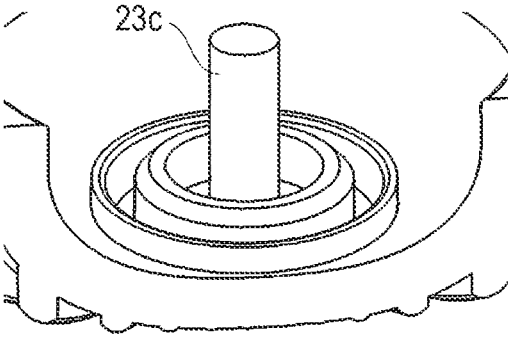
FIGS. 15A, 15B, and 15C are perspective views illustrating a modification example of a protrusion according to the second example embodiment.
Figure 15B:
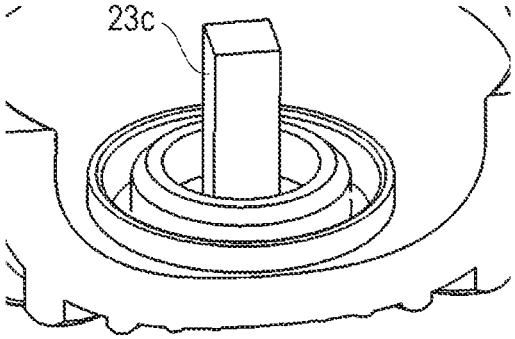
Figure 15C:
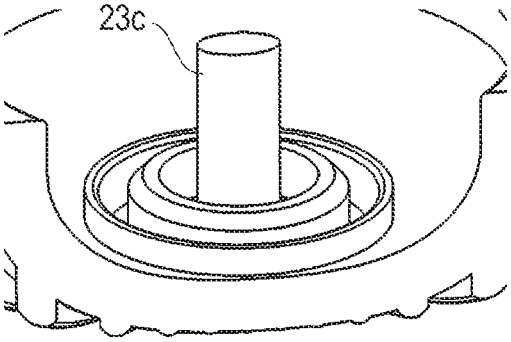

FIGS. 14A and 14B are enlarged cross-sectional views of a nozzle and a cap according to a second embodiment of the present disclosure and views illustrating a relationship between a slit valve and a protrusion when the cap is opened. Each of FIGS. 15A to 15C is a perspective view illustrating a modification example of the protrusion of the present embodiment. Hereinafter, the same components as those of the first embodiment are denoted by the same reference numerals in the drawings, description thereof will be omitted, and only configurations different from those of the first embodiment will be described.

In the present embodiment, the configuration of the protrusion 23*c* is different from that of the first embodiment. Accordingly, a method of releasing the pressure in the liquid storage bottle 2 when the cap 23 is opened or closed is different from that of the first embodiment. Specifically, as illustrated in FIG. 14A the protrusion 23*c* is inserted into the slit 24*b* of the slit valve 24 in a state where the inlet 22*c* sealed by the cap seal portion 23*b* and the nozzle seal portion 22*d*. If the cap 23 starts to be opened from this state, as illustrated in FIG. 14B, the sealing of the inlet 22*c* is released. However, even in this state, the protrusion 23*c* is inserted into the slit 24*b*. Therefore, in the present embodiment, when the sealing of the inlet 22*c* is released, the protrusion 23*c* is inserted into the slit 24*b*. Accordingly, even when the internal pressure in the liquid storage bottle 2 increases, the internal pressure can be released to the outside.

As described above, depending on the thickness of the protrusion 23*c*, if the protrusion 23*c* is inserted into the slit 24*b* near the intersection 24*d*, the closed state of the slit 24*b* may be maintained. In order to suppress this, the protrusion 23*c* can have a predetermined thickness. Specifically, in a case where the protrusion 23*c* has a columnar shape as illustrated in FIG. 15A, a diameter φ of the protrusion 23*c* can be ½ or more of a length L of the slit 24*b*. Thereby, even if the protrusion 23*c* is inserted into the slit 24*b*, it is possible to prevent the slit 24*b* from being maintained in the closed state, and thus, it is possible to reliably open the slit 24*b*.

The shape of the protrusion 23*c* can be a columnar shape as illustrated in FIG. 15A in that damages applied to the valve body 24*a* when the protrusion 23*c* is inserted into the slit 24*b* can be reduced. However, the shape of the protrusion 23*c* is not limited to this. For example, the protrusion 23*c* may have a prismatic shape as illustrated in FIG. 15B, or may have an elliptic-columnar shape as illustrated in FIG. 15C. Even in this case, the protrusion 23*c* can have a predetermined thickness. Specifically, a diameter φ of a circumscribed circle of the protrusion 23*c* can be ½ or more of the length L of the slit 24*b*.

While the present disclosure has been described with reference to example embodiments, it is to be understood that the disclosure is not limited to the disclosed example embodiments. The scope of the following claims is to be accorded the broadest interpretation so as to encompass all such modifications and equivalent structures and functions.

This application claims the benefit of Japanese Patent Application No. 2019-069101, filed Mar. 29, 2019, which is hereby incorporated by reference herein in its entirety.

What is claimed is:

1. A liquid storage bottle comprising:
a bottle main body;
a nozzle which has an inlet through which a liquid stored in the bottle main body is injected;
a cylindrical cap which is mountable on the nozzle to open or close the inlet;
a slit valve which is provided in the inlet and includes a plurality of slits intersecting each other; and
a sealing unit which seals the inlet when the cap is mounted on the nozzle,
wherein the cap includes a protrusion which protrudes from a surface facing the inlet toward the slit valve when the cap is mounted on the nozzle, and
wherein a tip portion of the protrusion faces the slit valve at a position separated in a radial direction of the nozzle from an intersection of the plurality of slits in a state where the inlet is sealed by the sealing unit.

2. The liquid storage bottle according to claim 1,
wherein the cap is provided with the protrusions the number of which is smaller than the number of split pieces formed by the plurality of slits.

3. The liquid storage bottle according to claim 2,
wherein the protrusion protrudes from an end surface of a columnar base portion which is provided on the surface of the cap.

4. The liquid storage bottle according to claim 2,
wherein the protrusion faces the slit valve at a position which is rotationally asymmetric with respect to the intersection.

5. The liquid storage bottle according to claim 4,
wherein the protrusion has a cylindrical shape in which a portion of an end surface is cut away.

6. The liquid storage bottle according to claim 1,
wherein a male screw is formed on an outer peripheral surface of the nozzle and a female screw which is screwed to the male screw is formed on an inner peripheral surface of the cap.

7. The liquid storage bottle according to claim 6,
wherein the tip portion of the protrusion is chamfered to have a flat surface shape or a curved surface shape.

8. The liquid storage bottle according to claim 7,
wherein the chamfer is provided to a corner of the tip portion which is located on an upstream side in a direction in which the protrusion moves when the cap is opened.

9. The liquid storage bottle according to claim 8,
wherein the chamfer is provided to a corner of the tip portion which is located on an upstream side in a direction in which the protrusion moves when the cap is closed.

10. The liquid storage bottle according to claim 6,
wherein the protrusion has a cylindrical shape in which an end surface is formed in a spiral shape.

11. The liquid storage bottle according to claim 1, wherein the slit valve is recessed inward with respect to a surface perpendicular to an axial direction of the nozzle.

12. The liquid storage bottle according to claim 1, wherein the slit valve includes a rigid frame member, and a valve body which is made of a material having flexibility, is fitted and held to the frame member, and has the plurality of slits formed.

13. A liquid storage bottle comprising:

a bottle main body;

a nozzle which has an inlet through which a liquid stored in the bottle main body is injected;

a cylindrical cap which is mountable on the nozzle to open or close the inlet;

a slit valve which is provided in the inlet and includes a plurality of slits intersecting each other; and a sealing unit which seals the inlet when the cap is mounted on the nozzle, wherein the cap includes a protrusion which protrudes from a surface facing the inlet toward the slit valve when the cap is mounted on the nozzle, and wherein the protrusion is inserted into the slit to open the slit during a period from a state where the inlet is sealed by the sealing unit to a state where sealing of the inlet is released by the sealing unit.

14. The liquid storage bottle according to claim 13, wherein a diameter of a circumscribed circle of the protrusion is ½ or more of a length of the slit.

15. The liquid storage bottle according to claim 14, wherein the protrusion has a prismatic shape, a columnar shape, or an elliptic-columnar shape.

16. The liquid storage bottle according to claim 13, wherein the slit valve is recessed inward with respect to a surface perpendicular to an axial direction of the nozzle.

17. The liquid storage bottle according to claim 13, wherein the slit valve includes a rigid frame member, and a valve body which is made of a material having flexibility, is fitted and held to the frame member, and has the plurality of slits formed.

* * * * *